US005954987A

United States Patent [19]

Han

[11] Patent Number: 5,954,987

[45] Date of Patent: Sep. 21, 1999

[54] MICROWAVE OVEN HAVING A WRAP FILM HANGER

[75] Inventor: Yong-woon Han, Suwon, Rep. of Korea

[73] Assignee: Samsung Electronics Co., Ltd., Suwon, Rep. of Korea

[21] Appl. No.: 09/084,877

[22] Filed: May 28, 1998

[30] Foreign Application Priority Data

Dec. 31, 1997 [KR] Rep. of Korea ..... P97-80276

[51] Int. Cl.[6] ..... H05B 6/80; B65D 25/52

[52] U.S. Cl. ..... 219/756; 219/725; 99/DIG. 14; 225/42; 225/43

[58] Field of Search ..... 219/756, 725; 225/42, 43; 99/DIG. 14

[56] References Cited

U.S. PATENT DOCUMENTS

| | | | |
|---|---|---|---|
| 2,919,336 | 12/1959 | Hahn | 219/756 |
| 3,221,132 | 11/1965 | Staats | 219/756 |
| 3,756,679 | 9/1973 | Schoenfelder | 312/237 |
| 3,870,212 | 3/1975 | Polk | 225/42 |

FOREIGN PATENT DOCUMENTS

| | | |
|---|---|---|
| 93-5421 | 8/1930 | Rep. of Korea . |
| 1 427 662 | 3/1976 | United Kingdom . |
| 2 088 825 | 6/1982 | United Kingdom . |

*Primary Examiner*—Philip H. Leung
*Attorney, Agent, or Firm*—Burns, Doane, Swecker & Mathis, L.L.P.

[57] ABSTRACT

Disclosed is a microwave oven having a wrap film hanger. The microwave oven has a wrap film hanger for receiving a wrap film which is used for sealing an opened side of a vessel. The wrap hanger comprises a cover which is pivotably installed about a rear end thereof so that an opening formed at the upper surface of the outer panel is covered by the first cover, a support for rotatably supporting the roll of wrap film in a space formed between the first cover and an upper surface of the cabinet assembly, a first roller installed at a front inner side of the first cover, a second roller disposed below the first roller in such a manner that a nip is formed between the first and second rollers so that the wrap film is passed out through the nip, and a cutting means for cutting the wrap film when the wrap film passing through the nip is ejected from a gap formed between the first cover and the outer panel.

15 Claims, 5 Drawing Sheets

MICROWAVE OVEN HAVING A WRAP FILM HANGER

BACKGROUND OF THE INVENTION

1. Field of the Invention

The present invention relates to a microwave oven, more particularly to a microwave oven having a wrap film hanger for receiving a wrap film which is used for sealing an opened side of a vessel having foods therein so as to prevent the moist of foods from being vaporized while the foods are cooked in the microwave oven.

2. Description of the Prior Art

Generally, a microwave oven is an appliance for cooking foods by using a microwave. In the microwave oven, a microwave is generated from a magnetron when a high voltage is applied to the magnetron, and then is radiated towards foods placed in a cavity through a wave guide. At this instance, water molecular contained in the foods are vibrated so that a heat energy is generated. The microwave oven cooks the foods by using the heat energy.

In such microwave oven, various foods can be cooked with various cooking ways by controlling the amount of the microwave radiated into the foods and radiating time of the microwave. In addition, the microwave oven can be used for warming cooked foods and for thawing frozen foods.

When the foods are cooked in the microwave oven, particularly when the cooked foods are warmed in the microwave oven, water contained in the foods is easily vaporized when it is heated by the microwave frequently causing the foods to be dried. To avoid this, a wrap film is used for sealing an opening side of a vessel having the foods therein so as to prevent the water of foods from being vaporized while the foods are heated or warmed in the microwave oven.

However, the conventional wrap film is received in a separate box or in a wrap hanger which is placed at the kitchen separately with the microwave oven. Accordingly, when it is required to use the wrap film, the user should move towards the box which is placed remote from the microwave oven in order to take the wrap film out of the box, thereby resulting an inconvenience for the user. It is also inconvenient for the user to return the remaining wrap film into the box.

SUMMARY OF THE INVENTION

The present invention has been made to overcome the above described problem of the prior art, and accordingly it is an object of the present invention to provide a microwave oven having a wrap hanger by which the user can easily use a wrap film thereof.

The above objects are accomplished by a microwave oven according to the present invention which characterized in that wrap hanger for storing wrap film which is for sealing open side of vessel with food therein, is installed at the microwave oven itself.

More specifically, the wrap hanger is attached to one side of outer panel of the microwave oven, or installed within the interspace between cabinet assembly forming cooking cavity and upper portion of outer panel.

When the wrap hanger is attached to the one side of outer panel, the wrap panel is a rectangular shaped body having an opened front side through which a roll of wrap film is received, a cutting means disposed at a front lower side of the body for cutting the wrap film, and a cover for covering the opened front side of the body.

The body is detachably coupled to the outer panel in such a manner that the body is alternately coupled to either side of the outer panel. For this purpose, the body is provided at a rear side thereof with coupling protrusions to be coupled through coupling holes respectively formed at the outer panel.

In addition, the cover has a window which is made of a transparent material so that amount of the wrap film in the body can be easily checked without opening the cover, or the cover itself can be made of transparent material.

With the construction according to the present invention as above, wrap hanger attached at one side of outer panel allows a user to use wrap film right away when he or she needs to.

On the other hand, when the wrap hanger is installed between cabinet assembly which forms the cooking cavity and upper portion of outer panel, the wrap hanger comprises a first cover which is pivotably installed about a rear end thereof so that an opening formed at the upper surface of the outer panel is covered by the first cover, a support for rotatably supporting the roll of wrap film in a space formed between the first cover and an upper surface of the cabinet assembly; a first roller installed at a front inner side of the first cover, a second roller disposed below the first roller in such a manner that a nip is formed between the first and second rollers so that wrap film is passed out through the nip, and a cutting means for cutting the wrap film when the wrap film passing through the nip is ejected from a gap formed between the first cover and the outer panel.

The first cover can be made of a transparent material so as to make checking of amount of wrap film easy.

The wrap hanger can further comprise a second cover installed at the upper surface of the cabinet assembly for preventing the wrap film from being subjected to a heat or a water vapor generated in the cavity.

As above, when wrap hanger is installed between cabinet assembly and upper portion of outer panel, wrap film is first wrapped around vessel and then cut. Accordingly, it enables a user to use just required amount of wrap film so that he or she can avoid the waste of wrap film.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE PREFERRED EMBODIMENT

Hereinafter, a preferred embodiment of the present invention will be described with reference to the accompanying drawings.

Figure 1:
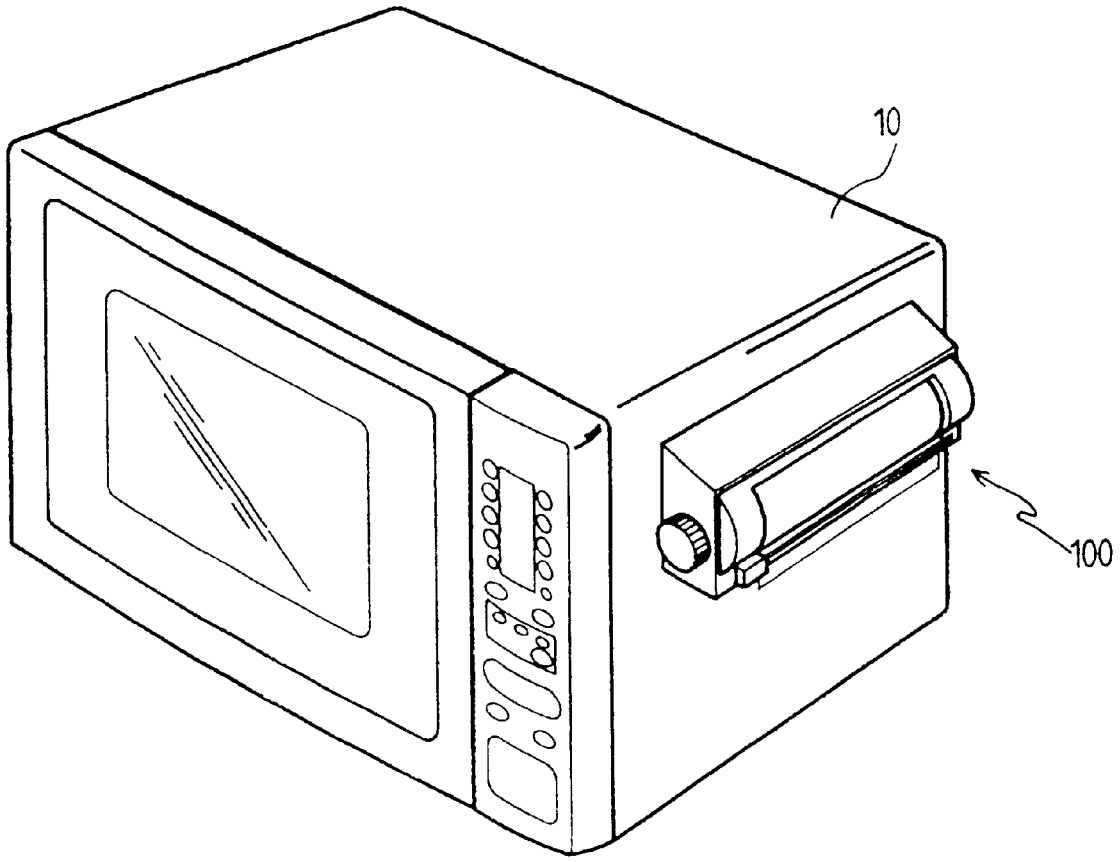
FIG. 1 is a perspective view showing a first embodiment of the present invention.
Figure 2:
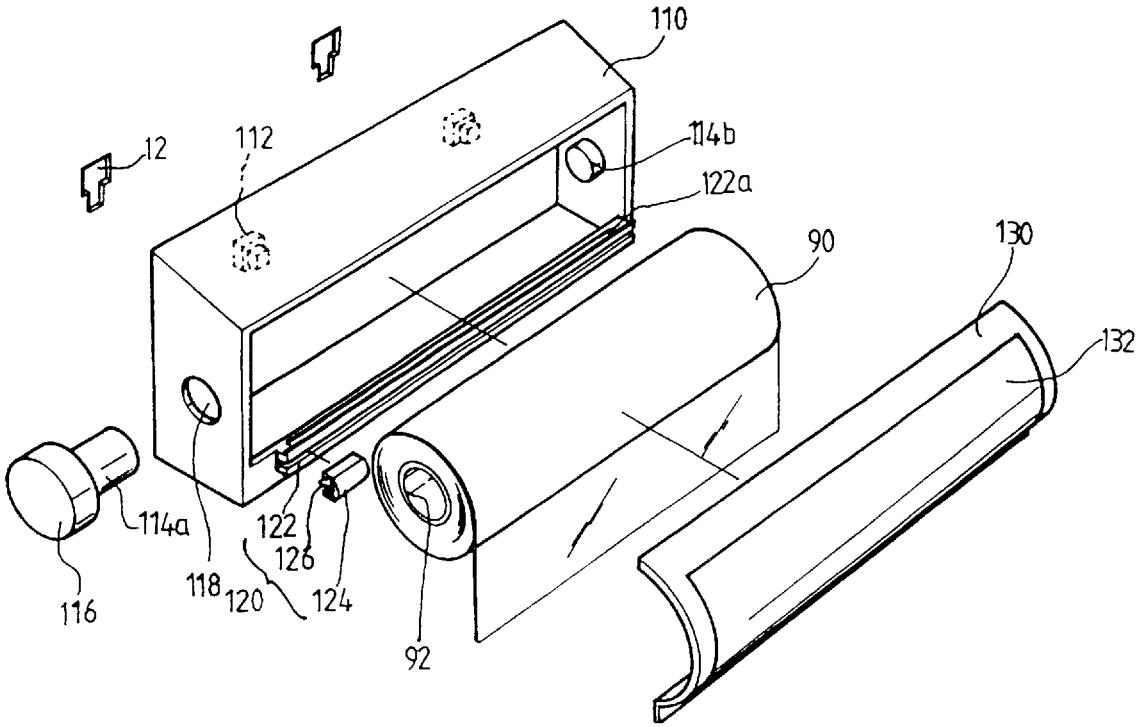
FIG. 2 is an exploded view of a wrap hanger shown in FIG. 1.
Figure 3:
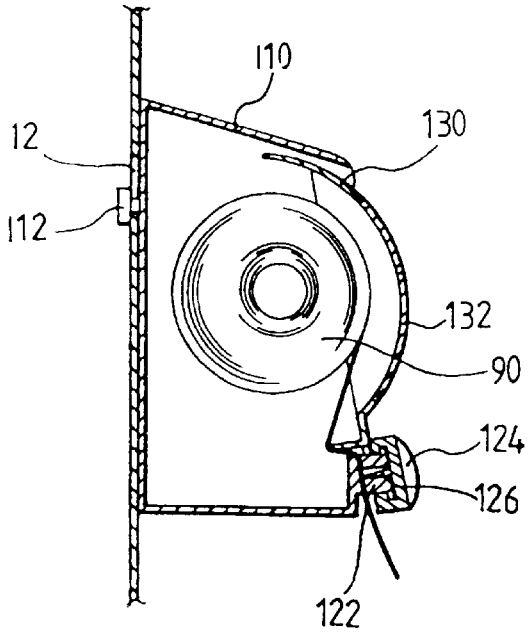
FIG. 3 is a sectional view of a wrap hanger shown in FIG. 1.

FIGS. 1 and 3 show a microwave oven having a wrap hanger 100 according to the first embodiment of the present invention.

As shown in the figures, wrap hanger 100 in which a wrap film 90 is received is attached to one side of outer panel 10 which defines an exterior of a housing of the microwave oven.

Wrap hanger 100 includes a case-shaped body 110 having an opened front side through which roll of wrap film 90 is received, a cutting section 120 disposed at a front lower side of body 110 for cutting wrap film 90 when wrap film 90 is released from body 110, and a cover 130 for covering the opened front side of body 110.

Body 110 is provided at a rear portion thereof with coupling protrusions 112, and outer panel 10 is formed at one side thereof with coupling holes 12. Preferably, outer panel 10 is formed at both sides thereof with coupling holes 12 so that wrap hanger 100 can be alternately coupled to either side of outer panel 10.

In addition, wrap film 90 is rotatably supported by support members 114*a* and 114*b* which are protruded from both sides of body 110. One support member 114*a* is integrally formed with a rotary knob 116 installed at outer side of body 110 and is inserted into a perforation 92 of wrap film 90 through a hole 118 formed at a side wall of body 110. Specifically, an outer circumference surface of support member 114*a* is tightly contacted with an inner circumference surface of perforation 92. In addition, the other support member 114*b* is integrally formed with body 110. Accordingly, when the user rotates rotary knob 116, support member 114*a* and wrap film 90 supported by support member 114*a* are rotated, letting some of wrap film 90 out downwardly.

In addition, cutting section 120 includes a guide 122 installed at the front lower side of body 110, a moving member 124 which is movable along guide 122, and a blade 126 which is fixed to moving member 124.

Guide 122 is formed across body 110 and has a slit 122*a* which is also lying across body 110 so that one side of wrap film 90 stored in body 110 passes through slit 122*a*. Blade 126 is extended from moving member 124 toward wrap film 90 such that an end of blade 126 makes contact with wrap film 90.

Cover 130 has a window 132 which is made of a transparent material so that an amount of wrap film 90 stored in body 110 can be checked through window 132 with opened front side of body 110 covered by cover 130.

The cover 130 can be made of a transparent material instead of having window 132 thereon. More preferably, body 110 itself can be made of a transparent material. In this case, the user checks the amount of wrap film 90 stored in body 110 more easily.

With above constructions, when wrap film 90 is received in body 110, one side end of wrap film 90 is extracted downwardly with respect to body 110 through slit 122*a* of guide 122. Then, cover 130 covers body 10.

In this state, if wrap film 90 is required, the user rotates rotary knob 116 so that the required amount of wrap film 90 can be released from body 110. After that, moving member 124 of cutting section 120 is moved from one side to the other side of guide 122. As a result, wrap film 90 is cut by blade 126 fixed to moving member 124. Accordingly, the user can seal the opened side of the vessel by using wrap film 90, and the sealed vessel is placed in the cavity of the microwave oven to be cooked.

Figure 4:
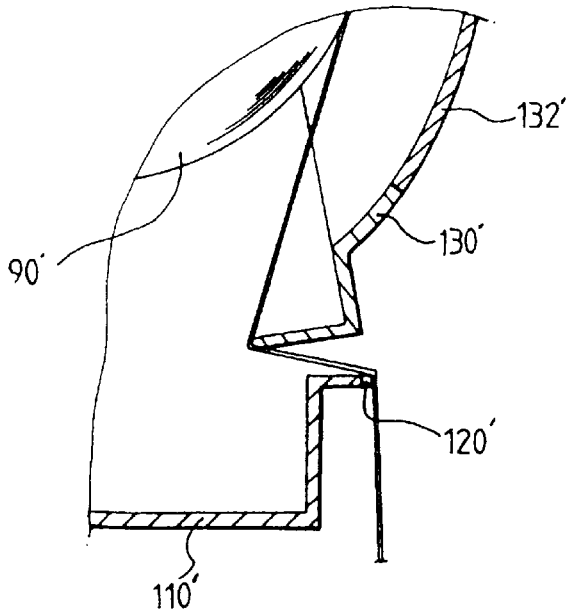
FIG. 4 is a sectional view of a wrap hanger of variation of the first embodiment of the present invention, in which a toothed cutting member is provided at a cutting section.

As shown in FIG. 4, instead of blade 126 fixed to moving member 124, a toothed cutting member 120' installed at a front lower portion of body 110' to be lying across body 110' can be used.

According to the first embodiment of the present invention, the wrap hanger in which the wrap film is received is integrally formed with a side of the outer panel. Accordingly, it is not required to store the wrap film in a separate place remote from the microwave oven. In addition, the user can easily and rapidly use the wrap film.

Figure 5:
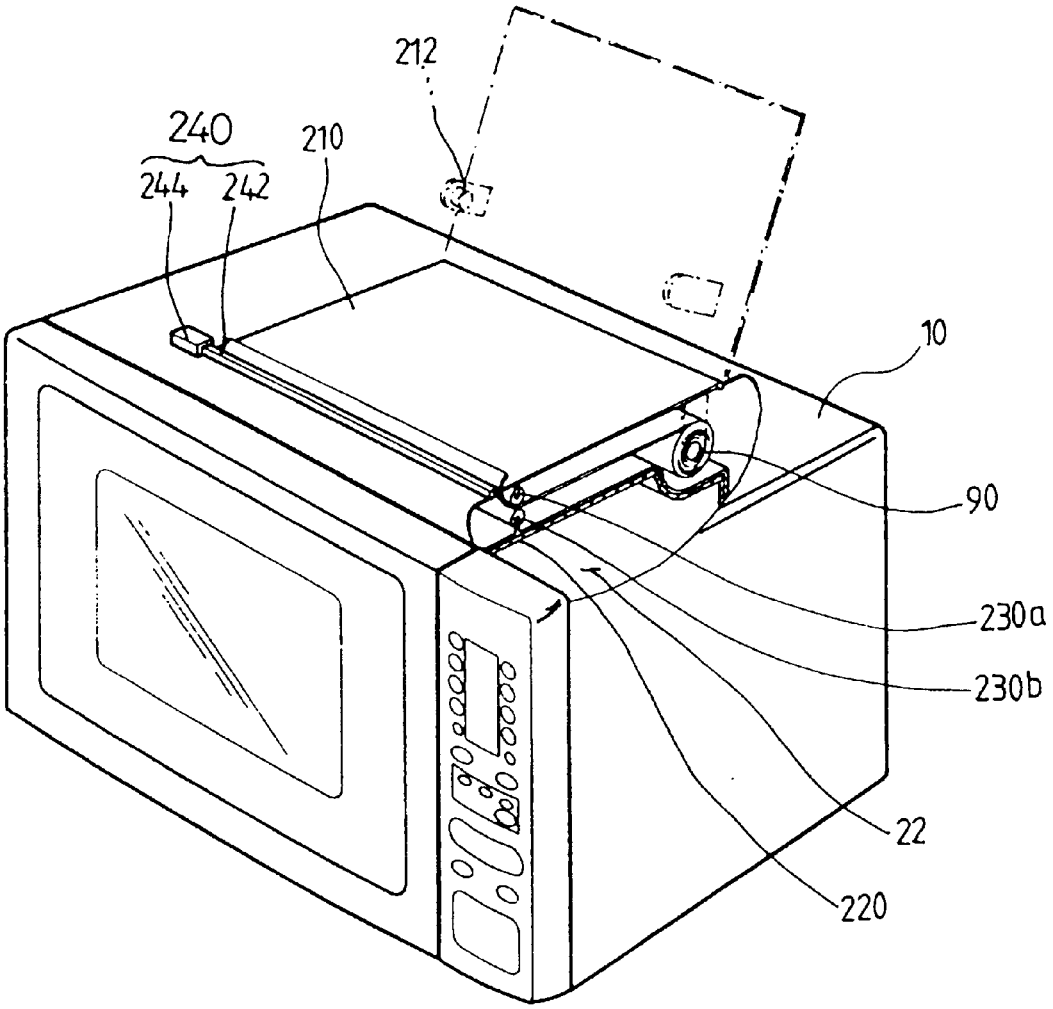
FIG. 5 is a perspective view showing a second embodiment of the present invention.
Figure 6:
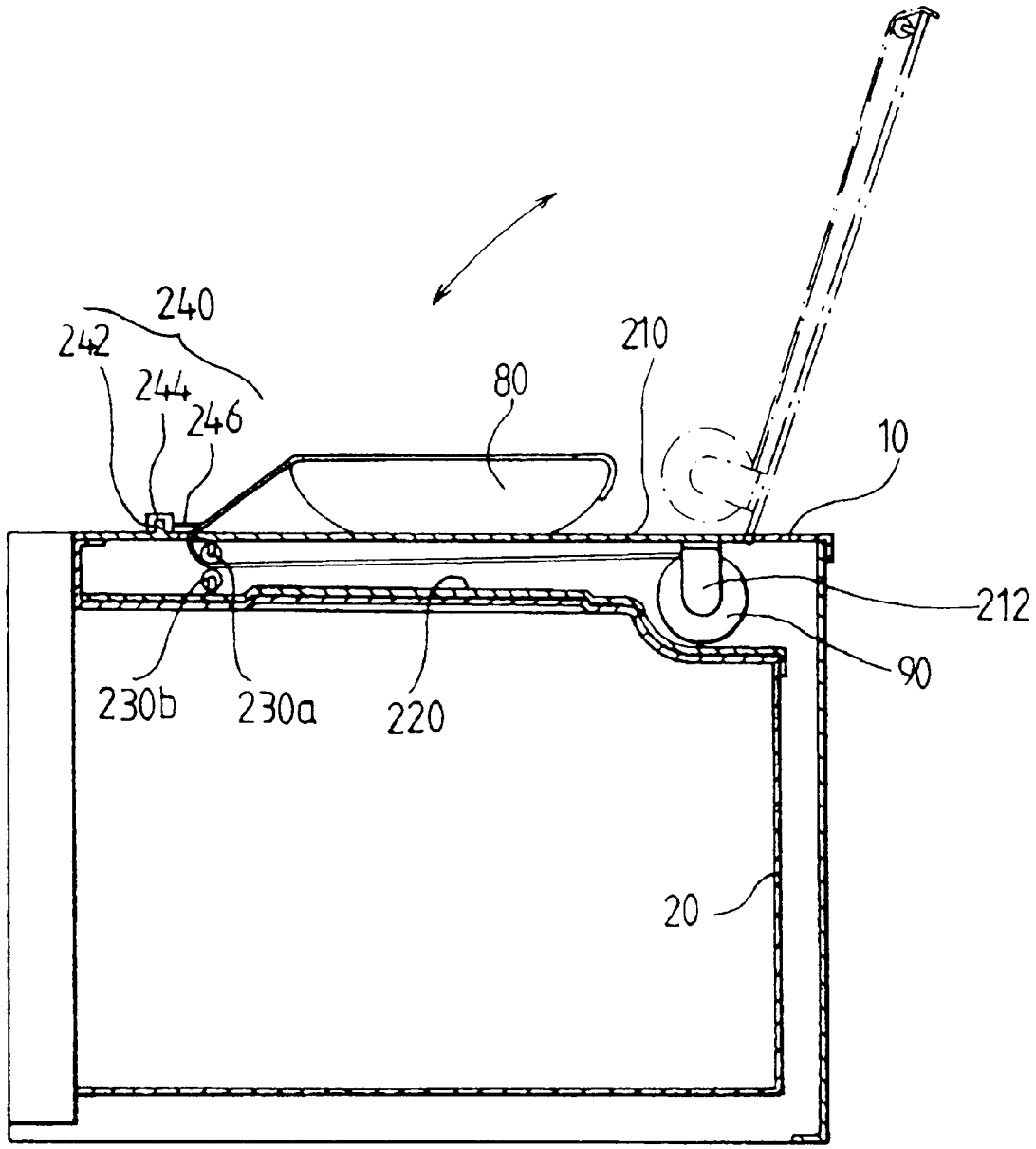
FIG. 6 is a sectional view showing the second embodiment of the present invention.

FIGS. 5 and 6 show another embodiment of the present invention.

As shown in the figures, a wrap hanger 200 for receiving the wrap film is installed between an upper surface of a cabinet assembly 20 and outer panel 10 which together form the housing of the oven.

A rectangular opening having a width identical to a width of wrap film 90 is formed on an upper surface of outer panel 10. Cover 210 for covering the rectangular opening is hinged to the rectangular opening in such a manner that cover 210 can pivot about a rear end thereof. A gap is formed between a front end of cover 210 and an inner end of outer panel 10 forming the rectangular opening.

A pair of supports 212 are installed on an underside of cover 210. Accordingly, the wrap film 90 is suspended by tile pair of supports 212 when wrap film 90 is received in a space formed between cover 2 10 and the upper surface of cabinet assembly 20.

In order to check the amount of wrap film 90 received in the space formed between cover 210 and cabinet assembly 20 without opening cover 210, cover 210 is preferably made of a transparent material.

In addition, a cover 220 is installed at the upper surface of cabinet assembly 20 for preventing wrap film 90 from being subjected to a heat or a water vapor generated in cavity 22. By cover 220, tile heat or the steam cannot penetrate into the space formed between the upper surface of cabinet assembly 20 and cover 210. Cover 220 is made of a material having a low thermal conductivity.

A first roller 230*a* is installed at inner front side of cover 210 and a second roller 230*b* is installed at cover 220 corresponding to first roller 230*a*, both formed to be lying across cover 210. Wrap film 90 supported by supports 212 passes through a nip formed between first and second rollers 230*a* and 230*b*. Wrap film 90 passing through the nip is ejected upwardly of cover 210 through the gap formed between cover 210 and outer panel 10.

In addition, a cutting member 240 for cutting wrap film 90 when wrap film 90 is ejected passing through a gap formed between cover 210 and outer panel 10 is installed at outer panel 10 adjacent to the front side of cover 210. Cutting member 240 includes a guide 242 installed at the upper surface of outer panel 10 to be lying across cover 210, a moving member 244 which is movable along guide 242, and a blade 246 which is moved by moving member 244. Though it is not shown in the figures, it is also possible to make cutting member 240 as a toothed cutting member formed at one side thereof with teeth. Since the construction of cutting member 240 is identical to that of the cutting member according to first embodiment of the present invention, further description is skipped.

As shown in a dot line in FIG. 6, tile user hangs wrap film 90 on supports 212 by opening cover 210. Then, one side of wrap film 90 is upwardly ejected towards the upper portion of cover 210, and then, cover 210 is closed so as to allow wrap film 90 to be received in the space between cover 210 and cabinet assembly 20.

In this state, if the user wants to seal the vessel having foods therein, as shown in FIG. 6, the user puts the vessel on the upper surface of cover 210 and seals the opening side of the vessel by pulling the one side of wrap film 90. After that, moving member 244 of cutting member 240 is moved along guide 242, thereby cutting wrap film 90. If cutting section 240 is the toothed cutting member, tile user pulls out the vessel sealed by wrap film 90 toward the front of cover 210. Then, wrap film 90 is cut by tile teeth of tile toothed cutting member.

According to the above embodiment, the wrap film is cut after the vessel is sealed by the wrap film. Accordingly, the amount of the wrap film required to seal the vessel can be more precisely determined compared with the first embodiment in which the vessel is sealed by the wrap film after wrap film is cut by guess. As a result, the waste of tile wrap film can be reduced, and the wrap film is prevented from sticking to each other which occurs when the user carries out the wrap film to seal the vessel.

According to the present invention, the microwave oven has a wrap hanger in which wrap film for sealing the opening side of the vessel having foods therein is received. Accordingly, the user can easily and conveniently use the wrap film without moving to a separate place remote from the microwave oven.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven comprising: a housing having first and second sides and forming a cooking cavity which opens at a front of the housing, a door mounted at the front of the housing for opening and closing the cooking cavity, a microwave generator disposed in the housing, a control panel mounted on the housing for controlling the microwave generator, and a wrap hanger mounted on an exterior surface of one of the first and second sides of the housing for containing a wrap film used for sealing vessels, the wrap hanger including a rectangular shaped body having an open front side through which a rolled wrap film is received, a cutting means disposed at a front lower side of the body for cutting the wrap film, and a cover for covering the open front side of the body.

2. The microwave oven as claimed in claim 1, wherein the body is detachably coupled to the housing in such a manner that the body is alternately coupled to either of the first and second sides.

3. The microwave oven as claimed in claim 2, wherein the body is provided at a rear side thereof with coupling protrusions, and the housing is provided at the first and second sides thereof with coupling holes, the body being alternately coupled to either of the first and second sides by inserting the coupling protrusions into the coupling holes thereof.

4. The microwave oven as claimed in claim 1, wherein the cover has a window which is made of a transparent material enabling a user to check an amount of the wrap film remaining in the body.

5. The microwave oven as claimed in claim 1, wherein the cover is made of a transparent material enabling a user to check an amount of the wrap film remaining in the body.

6. The microwave oven as claimed in claim 1, wherein the body is made of a transparent material.

7. The microwave oven as claimed in claim 1, wherein the body and cover are made of a transparent material.

8. The microwave oven as claimed in claim 1, wherein the cutting means includes a guide fixed to the front lower side of the body and having a slit hole into which one side of wrap film received in the body passes through, a moving member which is movable along the guide, and a blade which is moved by the moving member so as to cut the wrap film.

9. The microwave oven as claimed in claim 1, wherein the cutting means includes a toothed cutting member which is fixed to the front lower side of the body and is formed at a lower end thereof with teeth.

10. A microwave oven comprising: a housing including a cabinet assembly forming a cooking cavity, and an outer panel encompassing the cabinet assembly, a top wall of the outer panel being spaced above a top wall of the cabinet assembly to form a space therebetween; a door mounted on the housing for opening and closing the cooking cavity; a microwave generator disposed in the housing; a control panel mounted on the housing for controlling the microwave generator; and a wrap hanger mounted on the housing for containing a roll of wrap film used for sealing vessels; the wrap hanger disposed in the space and situated beneath an opening formed in the top wall of the outer panel, the wrap hanger comprising:

a cover which is pivotably installed about a rear end thereof to the top wall of the outer panel for exposing and closing the opening, a gap formed between adjacent edges of the cover and the top wall of the outer panel for enabling wrap film to pass therethrough, a support disposed on the cover for rotatably supporting a roll of wrap film in the space when the cover is closed, a first roller installed at a front inner side of the cover, a second roller mounted on the top wall of the cabinet assembly and disposed below the first roller in such a manner that a nip is formed between the first and second rollers, letting wrap film pass therethrough, and a cutting means disposed adjacent the gap for cutting wrap film passing through the gap.

11. The microwave oven as claimed in claim 10, wherein the first cover is made of a transparent material.

12. The microwave oven as claimed in claim 10, wherein the top wall of the cabinet assembly comprises a cover disposed beneath the support for preventing the wrap film from being subjected to heat or water vapor generated in the cooking cavity.

13. The microwave oven as claimed in claim 12, wherein the second cover is made of a material having a low thermal conductivity.

14. The microwave oven as claimed in claim 10, wherein the cutting means comprises:

a guide installed on the upper surface of the top wall of the outer panel adjacent to a front edge of the cover, the guide being disposed across the front edge;

a moving member which is movable along the guide; and a blade which is moved by a moving member so as to cut the wrap film when the wrap film is pulled from the gap formed between the cover and the outer panel.

15. The microwave oven as claimed in claim 10, wherein the cutting means includes a toothed cutting member which is installed on the upper surface of the top wall of the outer panel adjacent to a front edge of the cover.

* * * * *